US007412994B2

(12) United States Patent
Corless et al.

(10) Patent No.: US 7,412,994 B2
(45) Date of Patent: Aug. 19, 2008

(54) FUEL DISPENSING SYSTEM AND METHOD

(75) Inventors: Adrian James Corless, Vancouver (CA); Noel Christopher Buckley, Burnaby (CA); Darrin Grant Elliott, North Vancouver (CA); Carolyn A. Lawrence, Whistler (CA); David Reinhold Pfeil, West Vancouver (CA)

(73) Assignee: Cellex Power Products, Inc., Richmond, B.C. (CA)

( * ) Notice: Subject to any disclaimer, the term of this patent is extended or adjusted under 35 U.S.C. 154(b) by 0 days.

(21) Appl. No.: 11/605,630

(22) Filed: Nov. 28, 2006

(65) Prior Publication Data

US 2007/0068596 A1 Mar. 29, 2007

Related U.S. Application Data

(62) Division of application No. 10/699,615, filed on Oct. 31, 2003, now Pat. No. 7,171,989.

(51) Int. Cl.
*B65B 1/30* (2006.01)

(52) U.S. Cl. ..... 141/198; 141/95; 141/98; 141/192

(58) Field of Classification Search ..... 141/2, 141/18, 59, 94, 95, 98, 192, 198, 346–350; 123/198 D See application file for complete search history.

(56) References Cited

U.S. PATENT DOCUMENTS

| | | | | |
|---|---|---|---|---|
| 5,159,523 | A | | 10/1992 | Claassen et al. |
| 5,330,073 | A | | 7/1994 | Collins et al. |
| 5,332,630 | A | | 7/1994 | Hsu |
| 5,346,406 | A | | 9/1994 | Hoffman et al. |
| 5,361,216 | A | | 11/1994 | Warn et al. |
| 5,720,327 | A | | 2/1998 | Foster, Jr. |
| 5,769,134 | A | * | 6/1998 | Kenney et al. ..... 141/59 |
| 5,771,178 | A | | 6/1998 | Stemporzewski, Jr. |
| 5,857,501 | A | | 1/1999 | Kelerich et al. |
| 5,890,520 | A | | 4/1999 | Johnson, Jr. |

(Continued)

FOREIGN PATENT DOCUMENTS

| | | |
|---|---|---|
| WO | WO 99/44936 | 9/1999 |

*Primary Examiner*—Timothy L Maust
(74) *Attorney, Agent, or Firm*—Oyen Wiggs Green & Mutala LLP

(57) ABSTRACT

This application relates to a fuel dispensing system and method for safely regulating transfer of fuel between a fuel dispenser and a fuel recipient. The fuel dispensing system may be used, for example, to replenish electric vehicles that use refillable electrochemical power generation systems, such as fuel cell hybrid systems using hydrogen fuel. The system employs a combination of interlocks and other safety features specifically adapted for high-risk indoor environments. Fueling cannot commence until the dispenser and the recipient are electrically bonded to minimize the risk of spark generation. The system may include, for example, a fuel supply subsystem for preventing fuel flow except during a fueling session, an immobilization subsystem for preventing relative movement of the dispenser and the recipient during a fueling session, a communication subsystem for enabling data exchange between the dispenser and the recipient, and a leak detection subsystem for monitoring the fueling site for fuel leaks. In order to minimize or negate the risk that hazardous and/or flammable products could be exposed to the atmosphere during a fueling session, the system ensures that fueling cannot commence until multiple safety criteria are satisfied.

15 Claims, 8 Drawing Sheets

U.S. PATENT DOCUMENTS

| | | | | |
|---|---|---|---|---|
| 5,956,259 | A | 9/1999 | Hartsell, Jr. et al. | |
| 6,026,868 | A | 2/2000 | Johnson, Jr. | |
| 6,363,299 | B1 | 3/2002 | Hartsell, Jr. | |
| 6,381,514 | B1 | 4/2002 | Hartsell, Jr. | |
| 6,401,767 | B1 | 6/2002 | Cohen et al. | |
| 6,466,842 | B1 | 10/2002 | Harsell, Jr. | |
| 6,497,363 | B1 | 12/2002 | Kelrich | |
| 6,522,947 | B1 | 2/2003 | Harsell, Jr. | |
| 6,655,424 | B2 * | 12/2003 | Kawazu et al. | 141/98 |
| 2002/0162601 | A1 | 11/2002 | Jin et al. | |
| 2003/0134167 | A1 | 7/2003 | Hirakata | |

* cited by examiner

FUEL DISPENSING SYSTEM AND METHOD

RELATED APPLICATION

This application is a divisional of application Ser. No. 10/699,615 filed 31 Oct. 2003 now U.S. Pat. No. 7,171,989.

TECHNICAL FIELD

This application relates to a fuel dispensing system and method for safely regulating transfer of fuel between a fuel dispenser and a fuel recipient.

BACKGROUND

There are many applications where safe refueling of vehicles or other fuel recipients is required. For example, the Applicant is developing fuel cell power supply systems suitable for use in non-road electric lift vehicles and the like. As described in a continuation (namely application Ser. No. 10/684,622) of Applicant's application Ser. No. 09/785,878, the disclosure of which is hereby incorporated by reference, Applicant's power supply systems are sized to replace conventional electric vehicle traction batteries. Although such systems have a much improved operating range in comparison to conventional battery systems, they must be periodically refueled. This requires safe and reliable systems for transferring hydrogen or reformable hydrocarbon fuels to the vehicle power supply.

Many non-road lift vehicles, such as forklift trucks and the like, operate in indoor environments such as warehouses and product storage/distribution facilities. The need to refuel fuel cell powered vehicles and the like indoors poses particular challenges. Indoor refueling is generally not permitted under fire codes except for a very few restricted applications, such as vehicle manufacturing plants and specially designed airplane hangers. This is due to the fact that safety risks are greatly increased since indoor environments do not allow for the natural dispersion of hazardous or flammable gases and liquids. Moreover, indoor environments often provide an ample supply of combustible materials.

Improved systems for ensuring safe refueling of vehicles utilizing hydrogen or other hazardous or flammable fuels are therefore required. Such systems should preferably include means for immobilizing the recipient vehicle during fueling sessions, means for reducing the risk of spark generation and fuel ignition, and means for automatically ending fueling in the case of fuel leaks or other system failures. The refueling systems must also be user-friendly so that they can be successfully and reliably implemented by vehicle operators who may not necessarily be familiar with refillable electro-chemical power generation systems.

Some dispenser systems for preventing unauthorized fueling of a vehicle or the like are known in the prior art. U.S. patent application Ser. No. 10/296,232, Hirakata, published 17 Jul. 2003 under publication No. US 2003/0134167 A1 describes a fuel cell fuel supply system for an electric vehicle. The system includes a hydrogen supply device which is connectable to a connector receptor of the vehicle's fuel tank. The connector receptor may include a lid for covering the connector receptor. When the system determines that the fuel cells are in a working state, the system prevents opening of the fuel lid, thus preventing refueling of the vehicle while the fuel cells are operational. When the system determines that the fuel cells are not operating, refueling of the vehicle is permitted. The hydrogen supply device may include a controller for transmitting control signals to and from a controller of the electric vehicle when the hydrogen supply is connected to the hydrogen inlet of the vehicle. The system also prevents movement of the vehicle (by disabling the fuel cells or any secondary battery) when the fuel lid is open, thus enhancing the safety of hydrogen supply.

While the Hirakata invention does include means for immobilizing the electrical vehicle during refueling, it does not include means for automatically terminating refueling in the case of a fuel leak or other similar system failure. Moreover, Hirakata does not describe an interlock for lockably coupling the hydrogen supply to the vehicle hydrogen inlet.

U.S. Pat. Nos. 6,522,947 and 6,466,842, Hartsell, dated 15 Oct. 2002 and 18 Feb. 2003 respectively, relate to a dispenser system for preventing unauthorized refueling of vehicles. The dispenser includes a receiver capable of receiving fuel delivery indicia transmitted from the vehicle, such as vehicle type, vehicle identity, diagnostics and the like. The dispenser is configured to end fuel dispensing if an improper fueling condition is identified.

U.S. Pat. No. 5,159,523, Claassen et al., relates to a grounding system and detection circuit for fueling aircraft or other mobile vehicles. The system prevents operation of a fuel dispensing system unless a proper grounding configuration is observed.

U.S. Pat. No. 6,497,363, Kelrich, issued 24 Dec. 2002 relates to an electrical connector with identification chip for use with vehicle refueling systems. According to this system the vehicle communicates with a refueling station separate from the vehicle through a fuel nozzle communicator arranged adjacent a fuel intake conduit of the vehicle.

U.S. Pat. No. 5,720,327, Foster, relates to a vehicle safety fueling system. The system includes a solenoid valve which disables the engine ignition system when a dispensing nozzle is placed within a vehicle fueling port. The Foster invention prevents accidental driving off with the vehicle from a fuel pump without first removing a fuel dispensing nozzle from the tank of the vehicle. According to the Foster invention a proximity switch, electrically connectable to the vehicle's starter, is located adjacent the inlet spout of the vehicle fuel tank.

U.S. Pat. No. 09/848,493, Jin et al., published under No. 2002/0162601 A1 dated 7 Nov. 2002, relates to a safety system for fueling vehicles which includes the generation of a vehicle confirmation signal which is transmitted from the vehicle to be filled to a fueling station. The system further includes a dispenser activation system responsive to the vehicle confirmation signal for activating dispensing of fuel through a fuel nozzle and a vehicle locking system to disable the vehicle while the vehicle fuel door is open or when the fueling nozzle is attached to the vehicle nozzle receptacle. The system may also include an emergency power off circuit to provide power to detection and alarm systems, such as fuel vapor detectors, malfunction alarms and active ventilation systems.

While various systems are known in the prior art for regulating transfer of fuel from a fueling station to a recipient vehicle or the like, none of the prior art include a combination of interlocks and other safety features which prevent refueling until multiple safety criteria are satisfied. The need has therefore arisen for improved fueling systems and methods designed to minimize or negate the risk that hazardous and/or flammable products could be exposed to the atmosphere during a fueling session. A particular need has arisen for fuel dispensing systems and methods specifically adapted for high-risk indoor environments.

SUMMARY OF INVENTION

In accordance with the invention, a method of regulating dispensing of fuel from a fuel dispenser having a fuel nozzle to a recipient having a fuel receptacle is provided. At least one of the dispenser and the recipient is ordinarily mobile. The method includes the steps of establishing an electrical bond between the dispenser and the recipient; immobilizing at least the one of the dispenser and the recipient which is ordinarily mobile to prevent relative motion of the dispenser and the recipient; coupling the nozzle to the receptacle; and dispensing fuel from the dispenser through the nozzle into the receptacle until a fuel shut-off condition arises.

The method may include the step of establishing a communication link between the dispenser and the recipient. The communication link may be wired or wireless. The method may include the step of transmitting a signal from the recipient to the dispenser via the communication link verifying, for example, when the recipient is immobilized, when the nozzle is coupled to the receptacle, when the electrical bond between the dispenser and the recipient has been established or when a sensor internal to the recipient has not detected any fuel (e.g. hydrogen or any other flammable fuel).

The method may include the step of sensing for fuel leaks in the vicinity of the recipient during the fueling period at locations external of the receptacle. A shut-off condition may arise, for example, when the concentration of fuel sensed by the detector exceeds a threshold amount. The threshold amount may be predetermined or may vary depending upon system parameters. In one example, the fuel is hydrogen and the shut-off condition may arise where the atmospheric concentration of hydrogen exceeds a threshold amount.

Various other shut-off conditions are possible. For example, a shut-off condition may arise if of the nozzle is decoupled from the recipient during a fuel session or if the electrical bond between the dispenser and the recipient is disrupted. A shut-off condition may also arise if the amount of fuel within the receptacle exceeds a threshold amount or if the fueling session has exceeded a predetermined period of time.

In one embodiment the recipient may be an electric vehicle having a traction motor and the step of immobilizing the recipient comprises disabling power to the traction motor. In one particular embodiment the vehicle may be a non-road electric vehicle having a fuel cell power supply system.

The step of establishing an electrical bond between the dispenser and recipient may comprise coupling an electrical ground cable therebetween to reduce the risk of spark generation. For enhanced safety and reliability, the nozzle may be lockably coupled to a receptacle inlet during the fueling period.

After the shut-off condition arises, the method may further include the steps of electrically disconnecting the dispenser and the recipient; decoupling the nozzle from the receptacle; and enabling mobilization of the recipient (or the dispenser if the dispenser is ordinarily mobile). For example, if the recipient is a mobile electric vehicle, the step of enabling mobilization may comprise providing power to the vehicle motor. The dispenser may include a fuel supply, a fuel supply conduit extending between the fuel supply and the nozzle, a control valve for regulating flow of fuel through the fuel supply line and a pump for pumping fuel through the fuel supply line. The control valve may be comprised and/or the fuel pump may be disabled when the fuel shut-off condition arises.

The invention also relates to a system for regulating the flow of fuel between a fuel dispenser having a fuel nozzle and a fuel recipient having a fuel receptacle during a fueling period. The system includes an electrical connector for electrically coupling the dispenser to the recipient, an interlock for lockably coupling the nozzle to a fuel inlet on the recipient in communication with the receptacle, and an immobilization subsystem for preventing relative motion of the dispenser and the recipient during the fueling period.

The system may also include a communication subsystem for transmitting control signals between the dispenser and the recipient and a fuel supply subsystem for preventing flow of fuel between the dispenser and the recipient other than during the fueling period. In one embodiment a controller may be operatively coupled to the communication subsystem and/or the fuel supply subsystem.

A fuel sensor may be provided for sensing the presence of fuel in the vicinity of the recipient external of the fuel receptacle during the fueling period. For example, the fuel sensor may comprise a hydrogen sensor.

In the case where recipient is a mobile vehicle, the immobilization subsystem may be adapted to disable power to the vehicle during the fueling period. For example, the immobilization subsystem may disable power to the motor of the vehicle during the fueling period.

The fuel supply subsystem may comprise a valve adjustable between an open position permitting flow of fuel through the nozzle into the receptacle inlet and a closed position preventing flow of fuel into the inlet. The fuel supply subsystem may further include a fuel pump or compressor adjustable between on and off positions for pumping fuel through the nozzle into the inlet during the fueling period. As indicated above, the fuel valve may be adjusted to the closed position and the fuel pump or compressor may be disabled (i.e. switched off) when a fueling shut-off condition arises.

BRIEF DESCRIPTION OF DRAWINGS

In drawings which illustrate embodiments of the invention, but which should not be construed as restricting the spirit or scope of the invention in any way.

FIG. 5(*b*) is a sectional view of a lockable panel for preventing access to the fuel nozzle of the fuel supply subsystem until after multiple safety criteria have been satisfied.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
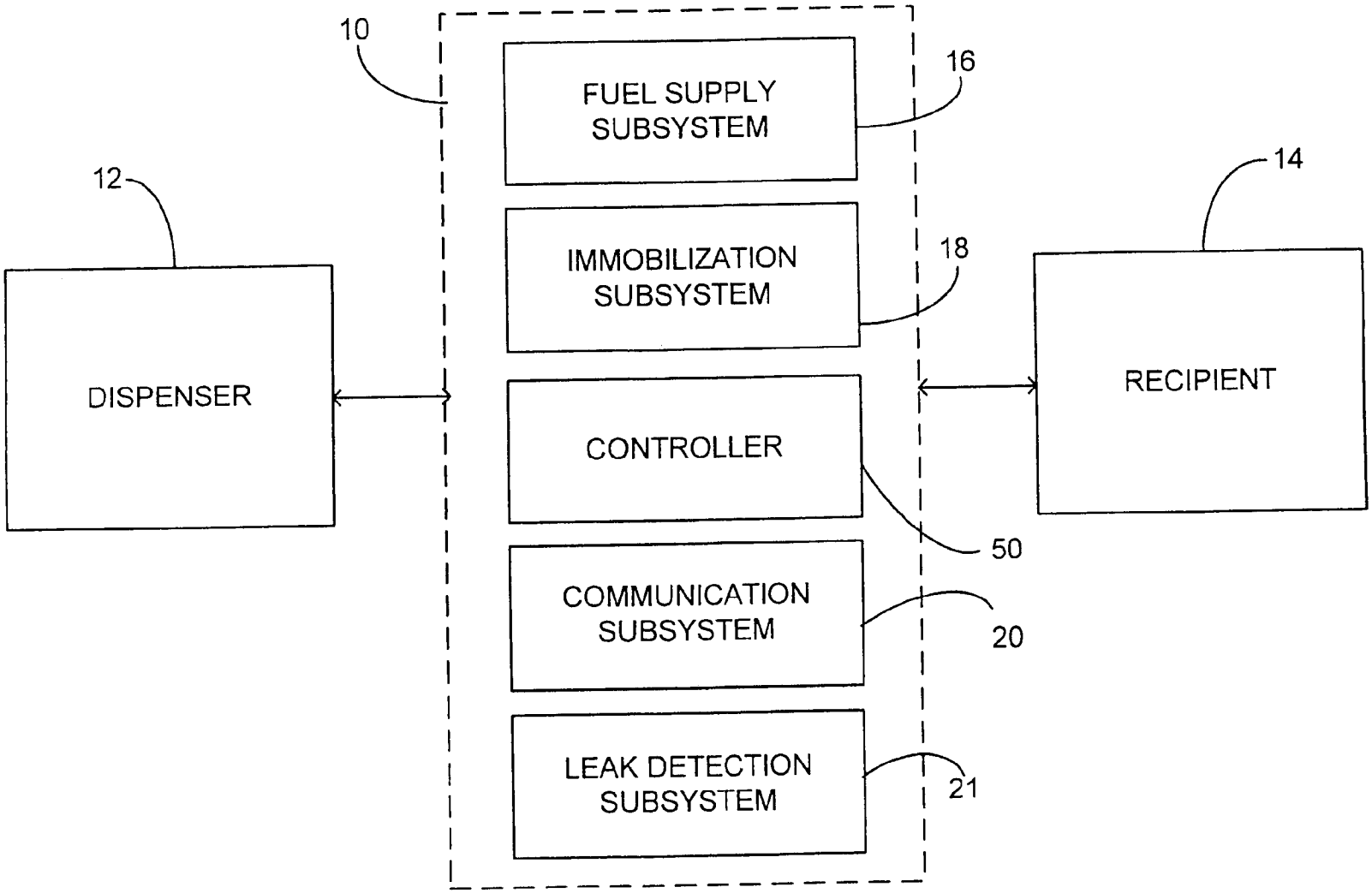
FIG. 1 is a schematic view of the applicant's fuel dispensing system.

FIG. 1 illustrates schematically applicant's system 10 for safely regulating dispensing of fuel from fuel dispenser 12 to a recipient 14. At least one of dispenser 12 and recipient 14 is ordinarily mobile. For example, in one embodiment of the invention described further below dispenser 12 is a fixed dispensing station and recipient 14 is a mobile vehicle. For example, recipient 14 may comprise an electric lift vehicle. In alternative embodiments of the invention recipient 14 could be fixed and dispenser 12 could be ordinarily mobile.

As shown in FIG. 1, system 10 may include a fuel supply subsystem 16, an immobilization subsystem 18, a communication subsystem 20 and a leak detection subsystem 21. Fuel supply subsystem 16 comprises means for safely delivering fuel from dispenser 12 to recipient 14 during a fueling period until a fuel shut-off condition arises. Immobilization subsystem 18 ensures that dispenser 12 and recipient 14 are held immobile during the fueling period. Communication subsystem 20 enables the transfer of control and diagnostic signals between dispenser 12 and recipient 14 as described further below. Leak detection subsystem 21 monitors the concentration of fuel in the vicinity of the fueling operation and disables the fuel supply subsystem 16 in the event a leak is detected.

In the embodiment illustrated in FIGS. 2-5, dispenser 12 is located at a fixed location in a fueling zone 22. In this embodiment fuel supply subsystem includes a fuel supply 24, a fuel nozzle 26 and a fuel supply line 28 for controllably delivering fuel from fuel supply 24 to nozzle 26. Fuel supply line 28 may include a control valve 30 for regulating the flow of fuel. A fuel pump or compressor 32 adjustable between on and off positions may also be provided for delivering fuel through fuel supply line 28.

Figure 3:
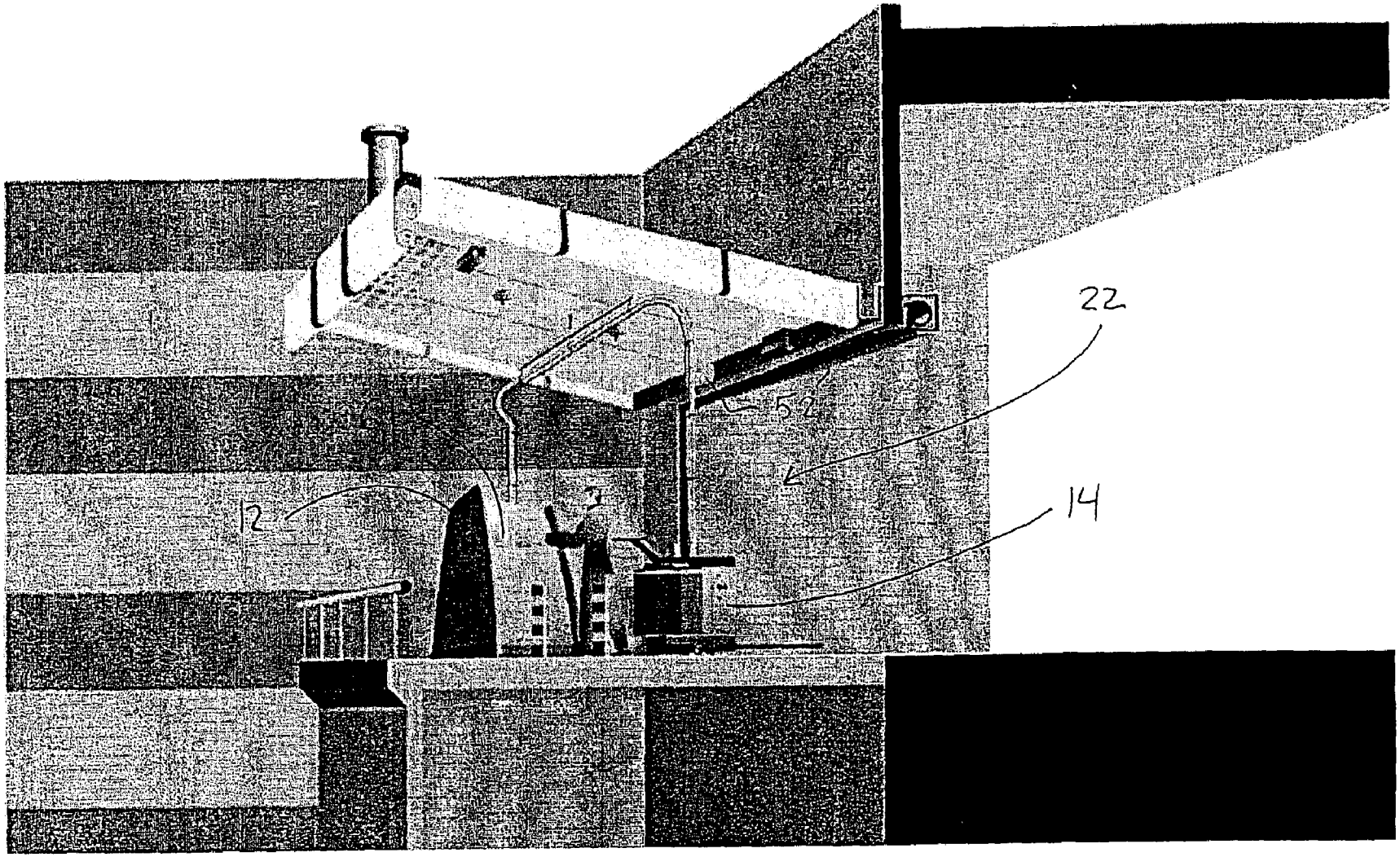
FIG. 3 is an isometric view of a fuel dispensing station showing a recipient vehicle in a fueling zone.
Figure 4:
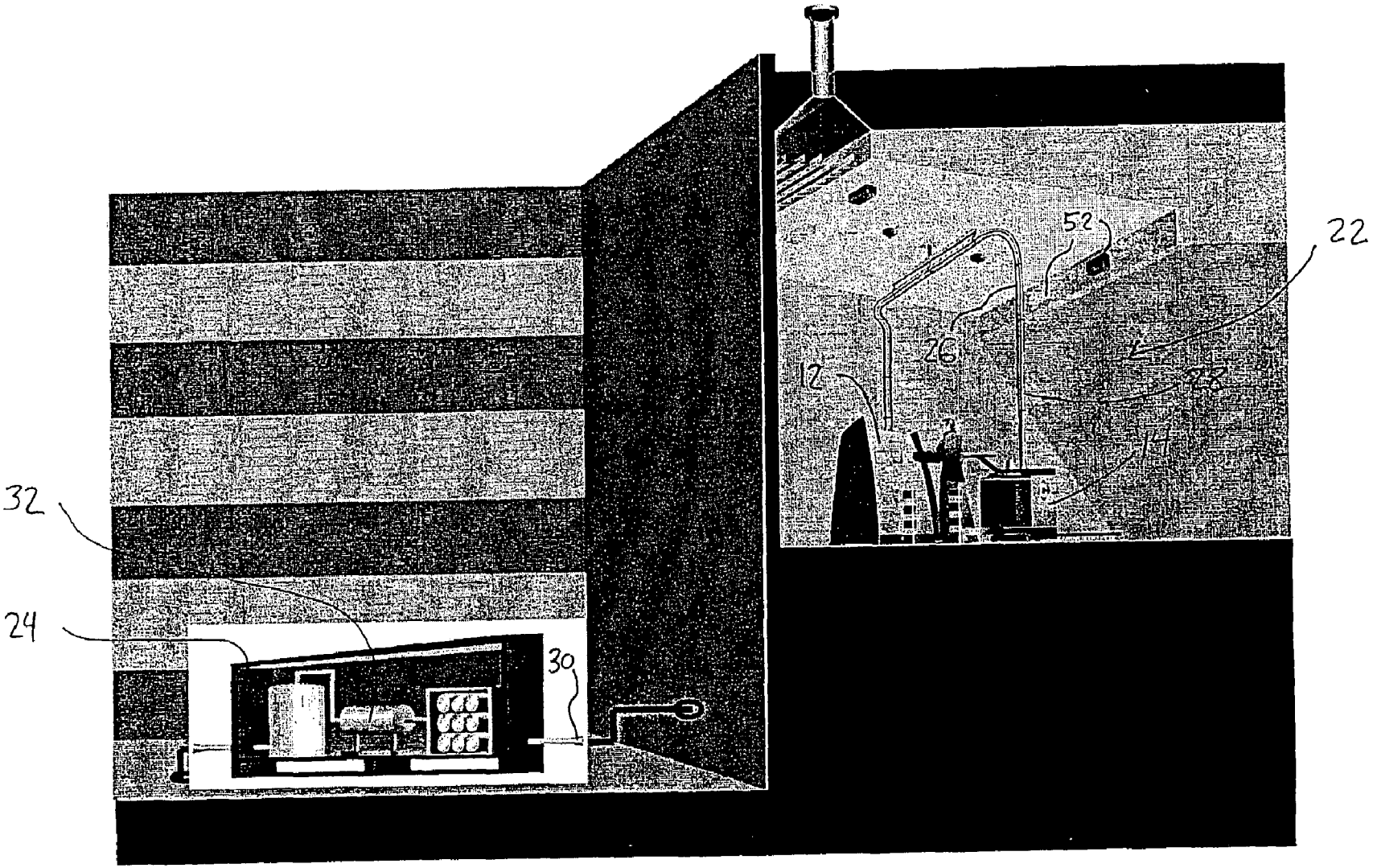
FIG. 4 is a further isometric view of a fuel dispensing station similar to FIG. 3 showing a recipient vehicle in a fueling zone.
Figure 5:
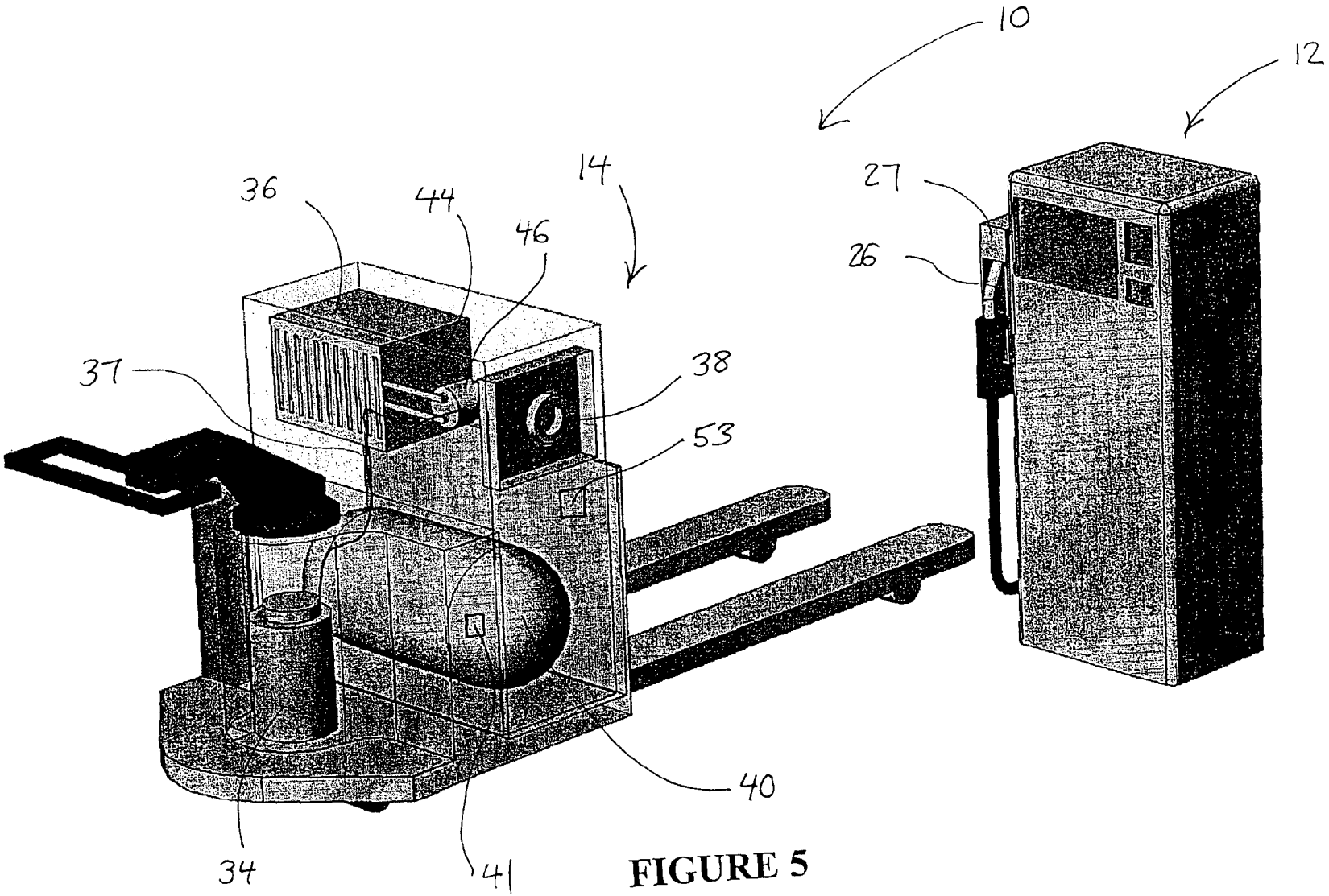
FIG. 5 is an isometric view of a fuel dispenser and recipient vehicle showing the internal components of the vehicle.
Figure 5B:
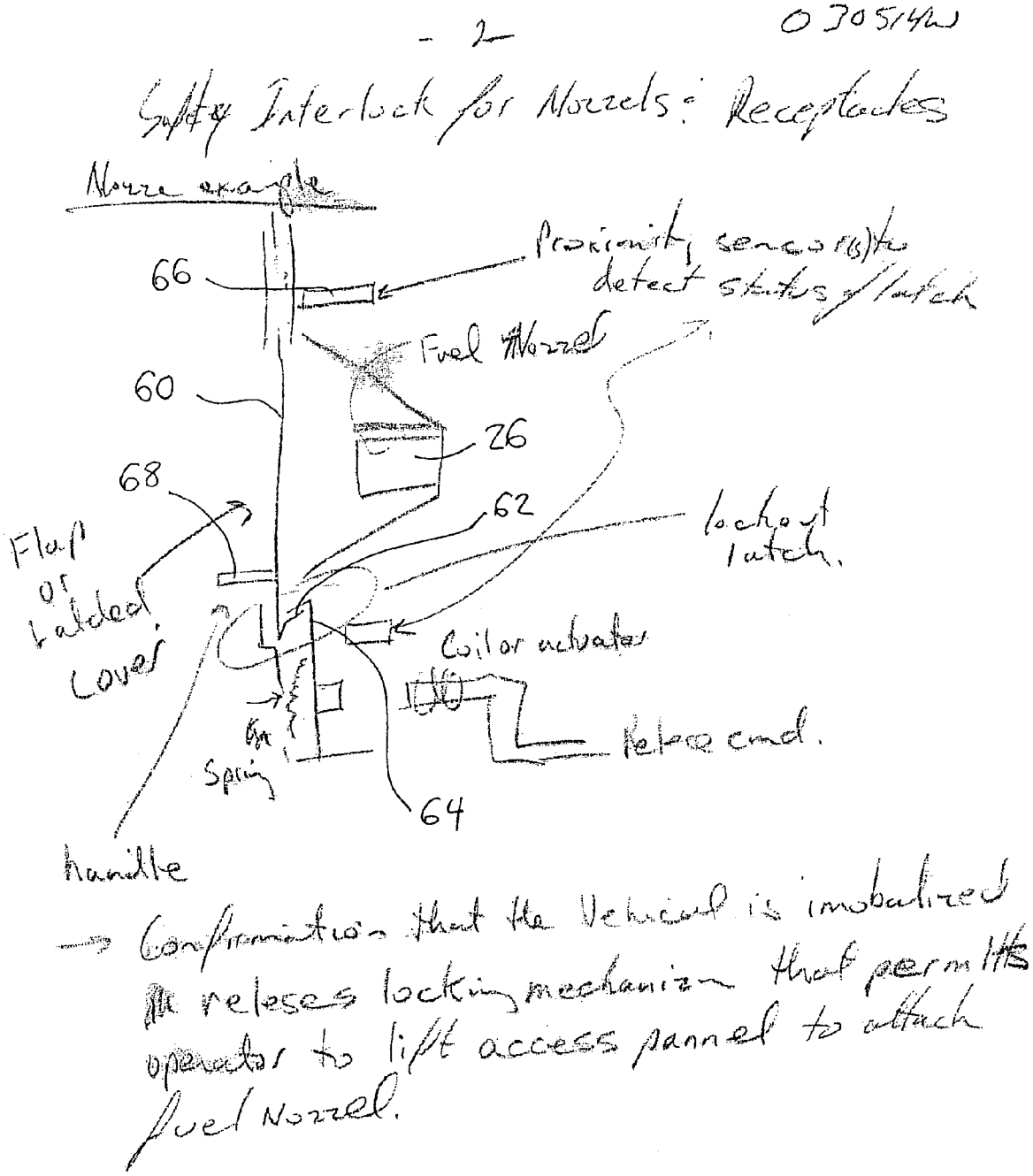

In the embodiments of FIGS. 3-5 recipient 14 is a mobile electric vehicle driven to fueling zone 22. As shown in FIG. 5, recipient 14 includes a motor 34 and a power supply 36 for providing power to motor 34 via a power cable 37. Power supply 36 may comprise, for example, a traction battery, a fuel cell or a hybrid fuel cell/battery power generation system An illustrative hybrid power supply is described in a pending continuation (namely application Ser. No. 10/684,622) of applicant's application Ser. No. 09/785,878, the disclosure of which is hereby incorporated by reference. Power supply 36 may be self-contained or may be fully integrated with motor 34.

In the embodiment illustrated in FIG. 5 recipient 14 also includes a fuel inlet port 38 and a fuel storage tank 40. Fuel inlet port 38 is sized to receive fuel nozzle 26 which is mountable in a holster 27 when not in use. A sensor 41 may also be provided for measuring the amount of fuel stored within tank 40.

Figure 2:
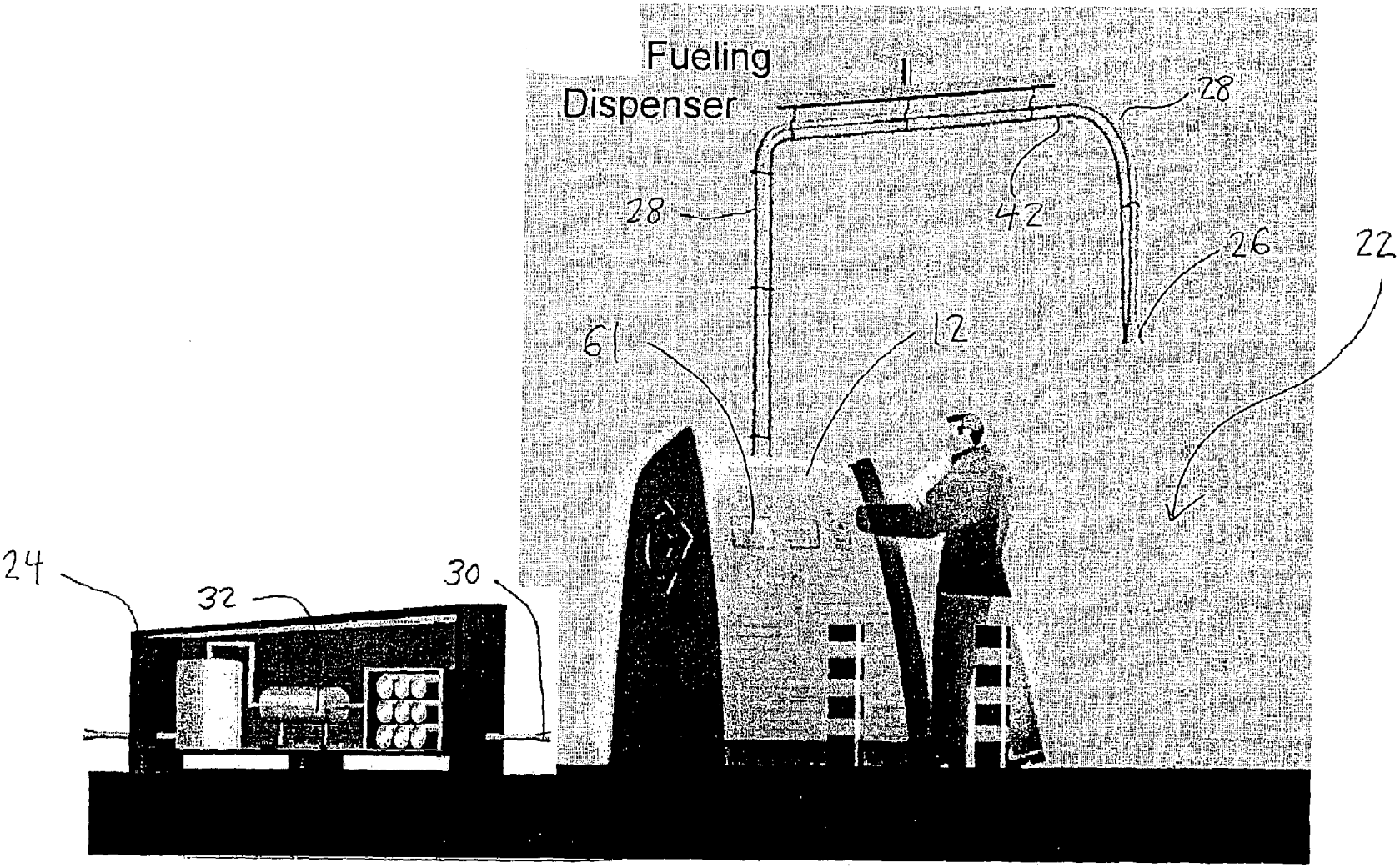
FIG. 2 is an enlarged isometric view of a fuel dispensing station including a dispenser having a fuel supply subsystem.

As best shown in FIG. 2, fuel dispensing system 10 further includes an electrical connector 42 for establishing an electrical bond between dispenser 12 and recipient 14 prior to commencement of a fueling session. The electrical bond ensures that no spark will be present in fueling zone 22 which will have enough energy to ignite a flammable fuel or fuel/air mixture. In the embodiment illustrated in FIG. 2-4 connector 42 consists of a ground cable having one end connected to dispenser 12 and the other end releasably connectable to recipient 14 when recipient 14 is moved into fueling zone 22. Connector 42 may include one or more wires. For example, the grounding wire may be coupled with communication wires or loop-backs. The loop-backs may be provided in the ground plug and/or receptacle to indicate that the ground is properly connected. In one embodiment the grounding electrical connector 42 may be bundled with or form part of the fuel supply line 28.

Immobilization subsystem 18 comprises means for disabling motor 34 of recipient 14 when it is moved into fueling zone 22 proximate dispenser 12. As will be appreciated by a person skilled in the art, various means for disabling motor 34 may be envisaged. In the illustrated embodiment of FIG. 5 recipient 14 includes a main power buss 44 between power supply 36 and motor 34. Power buss 44 includes a contactor 46 which is ordinarily closed. Prior to commencement of a fueling session, contactor 46 is adjusted to an open position to disable motor 34 and hence immobilize recipient 14 within fueling zone 22.

In another embodiment of the invention, a power cable (e.g. cable 37) extending between power supply 36 and motor 34 may be physically disconnected from motor 34 and plugged into a mating receptacle on dispenser 12. The effect is once again to immobilize recipient 14 within fueling zone 22. Dispenser 12 may be configured to acknowledge connection of the power cable, such as by a signal transmitted via communication subsystem 20.

Other immobilization subsystems 18 may also be envisaged. For example, a motor disabler, such as an electrical or mechanical brake may be used to prevent motor 34 from providing motive force to recipient 14. Alternatively, physical barrier(s), such as movable curbs or bollards, could be used within fueling zone 22 to prevent recipient 14 from moving during a fueling session. Immobilization subsystem 18 could also comprise means for disabling operation of recipient 14 by remote control, such as by transmitting a control signal from dispenser 12 to recipient 14 via communication subsystem 20 to thereby disable vehicle motive controls. Such a control signal could be sent, for example, upon connection of electrical connector 42 electrically bonding dispenser 12 and recipient 14 together.

Fuel dispensing system 10 may also optionally include communication subsystem 20 as described above to exchange data between dispenser 12 and recipient 14, or between one or more of dispenser 12 and recipient 14 and a controller 50 (FIG. 1). Various embodiments of communication subsystem 20 are possible. For example, subsystem 20 may be wired or wireless. In the case of wired embodiments, separate designated communication cables could be employed or communication signals could be transmitted along ground cable(s) or buss cable(s) connecting dispenser 12 and recipient 14. In the case of separate cable(s), such cable(s) could be bundled together with a ground wire, buss cable or refueling line, for example. Alternatively, the communications cable(s) could be entirely separate. In the case of wireless embodiments, radio frequency, ultrasonic, optical or other similar communication systems could be employed.

Different types of signals could be transmitted via communication subsystem 20. For example, control signals initiating or terminating a fueling session or diagnostic signals representing the operational status, mode or identity of dispenser 12 or recipient 14 could be transmitted. More particularly, if recipient 14 is a refueling vehicle, the maintenance history, maintenance requirements, operator habits and other vehicle diagnostic information could be transmitted (such information could be stored on a vehicle data recorder or logger). Communication subsystem 20 could also transmit operator input data, such as vehicle identification numbers or user passwords. Other diagnostic information could include vehicle run time, fuel consumption and the like.

Leak detection system preferably includes a fuel sensor 52 for detecting the presence of fuel leaks in the vicinity of recipient 14 externally of fuel storage tank 40 as shown best in FIG. 4. Sensor 52 may be operatively coupled to controller 50 (FIG. 1). The purpose of sensor 52 is to trigger shut-down of fuel supply subsystem 16 in the event of a fuel leak. Sensor 52 is particularly important if highly flammable or hazardous gases are used as fuels, such as hydrogen. For example, if the concentration of hydrogen in air exceeds about 4% there is a risk of explosion if the hydrogen is ignited.

System 10 may further include an interlock for releasably coupling nozzle 26 to fuel inlet port 38 during a fueling session. The interlock may consist of a latch which is releasably captured by a catch when nozzle 26 is inserted into port 38. In one embodiment, fuel supply subsystem 16 is not actuated until nozzle 26 and port 38 are interlocked in this manner. Other similar means for ensuring that nozzle 26 is in the desired dispensing position may also be employed, such as a magnetic or electromagnetic wave source.

System 10 may also include lockable access panels 60 for restricting access to nozzle 26 and fuel inlet port 38 until after dispenser 12 and recipient 14 are electrically coupled together and immobilized and it is otherwise safe for a fueling operation to commence. As shown in FIG. 5(*b*), each panel 60 includes a latch 62 which may be releasably captured by a catch 64. A proximity sensor 66 may be provided for detecting the positionable status of latch 62 and panel 60. Once sensor 66 senses that dispenser 12 and recipient 14 are in a suitable fueling position, catch 64 is disengaged and the operator may gain access to nozzle 26 or inlet port 38 by lifting handle 68. Nozzle 26 may then be lockably coupled to inlet port 38 as discussed above. More generally, a preliminary action (e.g. attachment of electrical connector 42, immobilization of recipient 14 etc.) must occur before access to fuel nozzle 26 and/or fuel inlet port 38 is permitted to occur. Thus fuel supply subsystem 16 is not operational until various safety criteria are satisfied.

Figure 6:
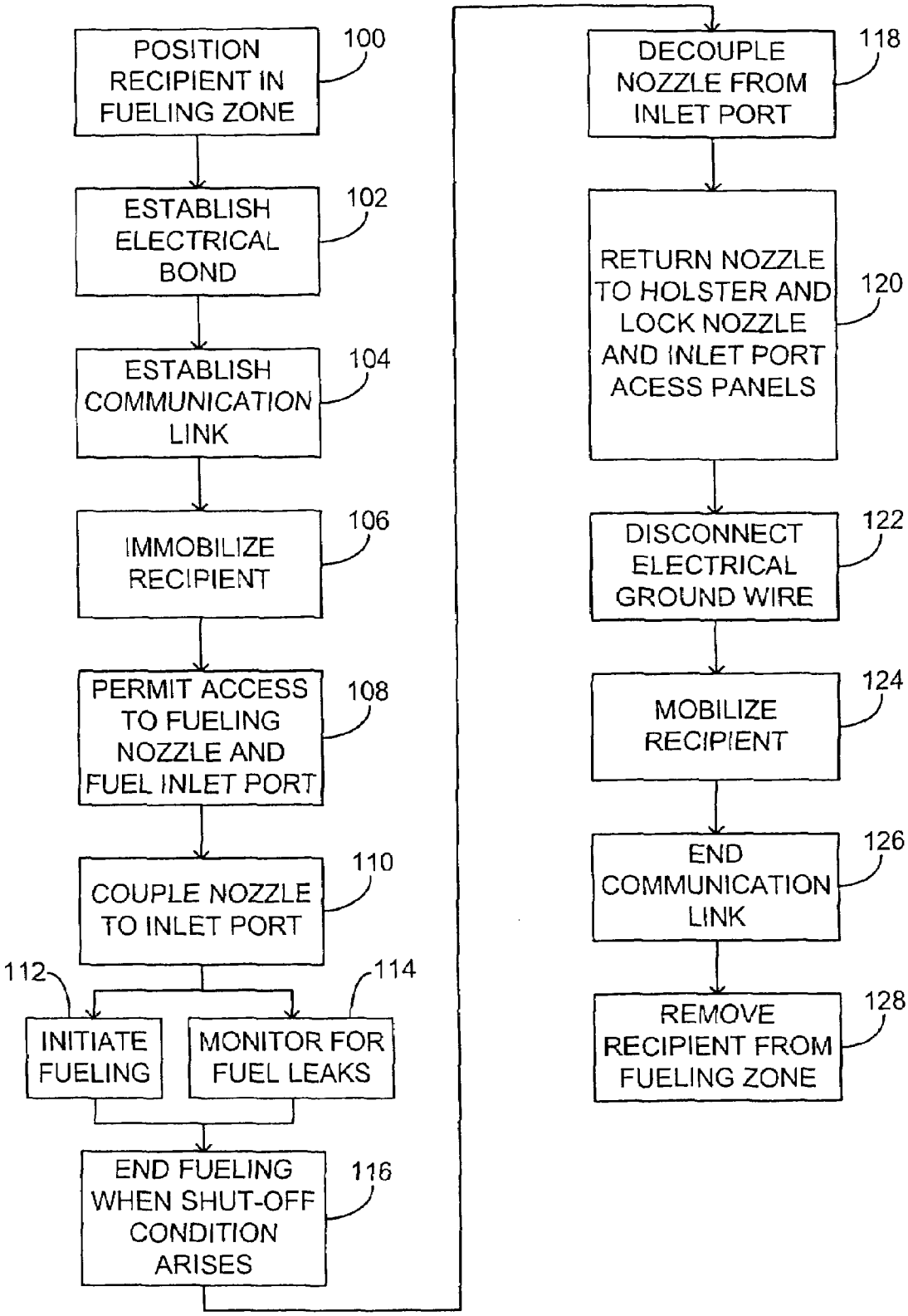
FIG. 6 is a flowchart showing the applicant's method for safely regulating dispensing of fuel from the dispensing station to the recipient.

FIG. 6 is a flowchart showing the process steps of applicant's method in accordance with one embodiment of the invention. In this example the fuel dispensing process is used to refuel a mobile recipient 14. The process begins at block 100 where recipient 14 is positioned in fueling zone 22 in proximity to fuel dispenser 12. Dispenser 12 and recipient 14 are then electrically coupled together by electrical connector 42 at block 102. As described above, electrical connector 42 may consist of a ground wire extending between dispenser 12 and recipient 14.

A communication link between dispenser 12 and recipient 14, or between dispenser 12 and/or recipient 14 and controller 50, may also be established as indicated at block 104. Controller 50 may form part of the dispensing station. In this example, the communication link enables information respecting the status and maintenance requirements of the vehicle to be uploaded to dispenser 12 and control signals to be downloaded from the dispenser 12 to recipient 14.

The next step in the process is to immobilize the recipient 14 within the fueling zone as indicated at block 106. As indicated above, immobilization may be achieved in several possible ways. For example, the recipient vehicle motor 34 may be disabled. As explained above, this could be achieved by transmitting a control signal via the communication link to adjust the contactor 46 to an open position. By way of another example, a power cable 37 may be disconnected from motor 34 and plugged into a receptacle on the dispenser 12.

In some embodiments of the invention recipient 14 could be operable in different modes, such as normal on, off and refueling modes. In the refueling mode it is possible that recipient 14 may be fully powered up so long as it is capable of being safely immobilized in that mode.

Once the system verifies that recipient 14 has been immobilized and dispenser 12 and recipient 14 are electrically coupled together, the next step in the process as shown at block 108 is to permit access to fueling nozzle 26 of dispenser 12 and fuel inlet port 38 of recipient 14. As explained above, nozzle 26 and dispenser 38 may ordinarily be located behind locked panels 60 (as discussed below, the panels are locked after each fueling session). At this stage in the process, controller 50 could send a signal via the communication link to release the panel locks. This would permit the operator to gain access to nozzle 26 and remove it from its storage holster 27. The operator could similarly expose vehicle fuel inlet port 38.

The next step in the process as shown at block 110 is to physically insert nozzle 26 into inlet port 38. As explained above, an interlock may be provided for lockably coupling nozzle 26 to fuel inlet port 38. Interlock prevents accidental decoupling of nozzle 26 from recipient 14 during a fueling session and thereby enhances the safety and reliability of the process. A status signal could be transmitted from recipient 14 to dispenser 12 via the communication link confirming that the interlock is engaged.

The system is now in condition for the fueling to begin. Fueling is initiated at block 112 to permit flow of fuel from dispenser 12 into fuel storage tank 40 of recipient 14. This may be achieved in many possible ways. For example a control signal could be sent from controller 50 to open fuel control valve 30 and actuate fuel pump or compressor 32. Other conventional means for triggering flow of fuel from dispenser 12 to recipient 14 could be substituted.

While fuel is flowing from dispenser 12 the system preferably monitors fueling zone 22 for fuel leaks as indicated at block 114. For example, if the fuel is hydrogen the system could include a sensor 52 sensing for the presence of hydrogen gas (FIG. 4). In another embodiment of the invention, sensor 52 could be operational continuously and not just during fueling sessions.

The fueling session continues until a shut-off condition arises as shown at block 116. Various shut-off conditions are possible. For example, the recipient 14 could send a status signal to dispenser 12 when sensor 41 senses that the vehicle fuel storage tank 40 is sufficiently full. Alternatively or additionally, the system could include a timer which triggers a shut-off condition after a predetermined length of time based on system parameters has elapsed. A shut-off condition may also arise in the case of system failures. For example, the system is configured so that fueling will automatically stop if the electrical ground connection between dispenser 12 and recipient 14 fails or if a fuel leak is detected. A shut-off condition would also arise if the immobilization subsystem 18 or communication subsystem 20 fail. The fuel session could be terminated, for example, by sending a control signal closing valve 30 and/or deactivating fuel pump or compressor 32.

In one embodiment of the invention a shut-off condition could arise when a sensor 53 internal to recipient 14 (FIG. 4) detects an unsafe operating condition. For example, the sensor 53 could detect a hydrogen leak within recipient 14. Alternatively sensor 53 could detect when a fan used to purge gases from recipient 14 is disabled or when any other potentially unsafe internal condition arises.

If the fueling session is terminated due to detection of a fuel leak, the system would shut-off the fuel supply. Optionally a dispenser station ventilation system could also be activated or ramped up to assist in leak dissipation.

Once the fueling session is completed and the system has verified that no fuel is flowing, the interlock may be disengaged and nozzle 26 may be decoupled from inlet port 38 as shown at block 118. As shown at block 120, nozzle 26 may then be returned to its holster 27 on dispenser 12 and the access panels covering nozzle 26 and inlet port 38 may be closed and locked in place. The system could be configured to verify that nozzle 26 has safely been returned to its holster 27 before further process steps will be authorized.

The next step in the process as shown at block 122 is to electrically decouple recipient 14 from dispenser 12, such as by disconnecting the ground wire tethering recipient 14 to dispenser 12. The recipient 14 may then by mobilized as indicated at block 124. For example, a control signal could be sent via the communication link causing contactor 46 to close thereby connecting a power supply to motor 34. Alternatively, a power supply cable could be physically removed from a dispenser receptacle and reconnected to motor 34. Many other means for mobilizing recipient 14 may be envisaged.

Depending upon the system configuration, the communication link could then be terminated as indicated at block 126. In some embodiments where the communication subsystem 20 includes wire connectors, such connectors could be disengaged from recipient 20, thereby ending the communication link, before recipient 14 is mobilized.

Recipient 14 is now completely disengaged from dispenser 12. The final step in the process is to remove recipient 14 from fueling zone 22 to permit refueling of another vehicle.

As will be appreciated by a person skilled in the art, may variations of the process steps shown in FIG. 6 are possible without departing from the invention. For example, in one alternative embodiment dispenser 12 may be ordinarily mobile and recipient 14 may be fixed. In yet another embodiment both dispenser 12 and recipient 14 may be ordinarily mobile.

In one possible embodiment communication subsystem 20 could include an interface to a building alarm or a local fire department. This would allow for prompt warning of a fuel leak or other emergency condition.

EXAMPLE

Figure 7:
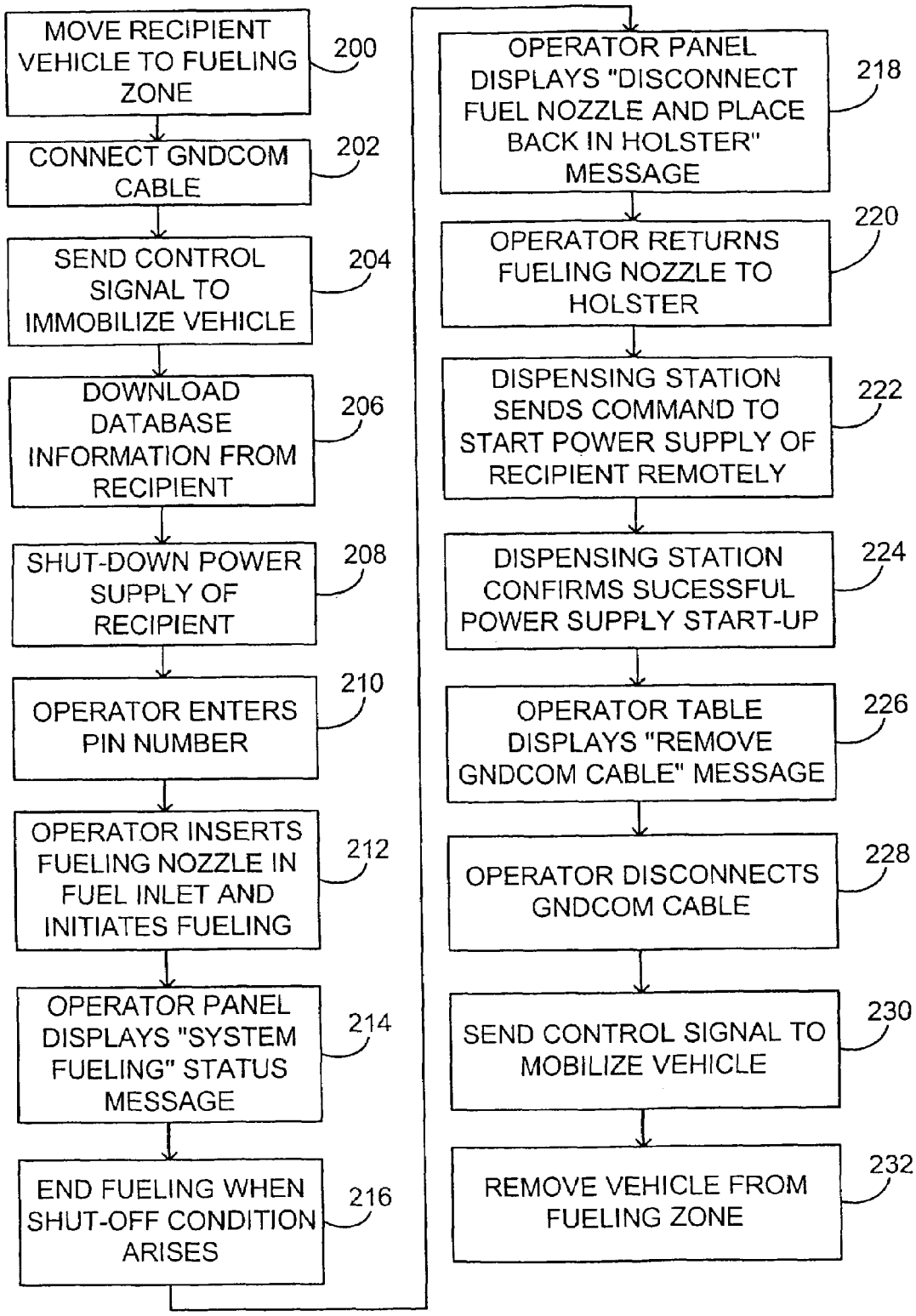
FIG. 7 is a flowchart illustrating an alternative embodiment of the applicant's method.

FIG. 7 is a flowchart illustrating a specific embodiment of the invention for dispensing hydrogen fuel to a mobile vehicle having a refillable electrochemical power generation system. The FIG. 7 system is configured to enable vehicle operators to accomplish their own refueling in a safe manner. In this example the mobile vehicle could include an operator display and interface panel to prompt the operator to follow the correct sequence of refueling steps.

The first step in the process is for the vehicle operator to drive the vehicle recipient 14 to the fueling zone 22 proximate fuel dispenser 12 as indicated at block 200. The operator display panel 61 then displays the instruction "Attach Ground and Communications (GNDCOM) Cable to Power Unit". With the vehicle power supply still operating the operator connects the GNDCOM cable to the vehicle as shown at block 202.

Once the GNDCOM cable is connected, the recipient vehicle is instantly demobilized. More particularly, the system sends a control signal from the dispenser 12 to recipient 14 to disable the main contactor within the vehicle power supply. This will in turn immobilize the vehicle.

The next step in the FIG. 7 process is for dispenser 12 to check the operational status of recipient 14 and download database information from the power supply (or some other module of recipient 14) via the communication link (block 206). The dispenser 12 then requests permission from recipient 143 to shut down the power supply. If appropriate authorization is received, the dispenser 12 sends a control command to power down the power supply. The recipient 14 then sends a signal acknowledging that the power supply is now in a shut-down or standby mode.

The next step is for the operator of the recipient 14 to enter a personal identification number (PIN) into the operator display panel as shown at block 210. If the PIN number is approved, the operator receives a prompt, such as "Attach fueling nozzle and press START FUELING button". The operator then inserts the fueling nozzle 26 into the fuel inlet port 38 of the recipient 14 and presses the START FUELING button. The fueling process is then initiated and the operator panels display a "SYSTEM FUELING" status message as indicated at block 214. The fueling session continues until a shut-off condition arises (block 216). For example, the fueling could continue until a fuel sensor 41 sends a signal to the dispenser 12 that the fuel receptacle 40 has been filled to the appropriate level.

As shown at block 218, the operator panel will then display a message instructing the operator to "DISCONNECT FUEL NOZZLE AND RETURN NOZZLE TO HOLSTER". After the operator returns the fueling nozzle to its holster (block 220) the system checks the status of system requirements and sends a command to start the recipient vehicle power supply if no errors are detected (block 222). More particularly, the dispenser 12 may send a control signal to start the power supply. Once the dispenser 12 confirms that the power supply has been successfully started (block 224) the operator panel displays a "REMOVE GNDCOM CABLE" message (block 226) After the operator removes the GNDCOM cable (block 228) the vehicle power supply automatically gains control of the main contactor to mobilize the vehicle. Finally, the operator can remove the recipient 14 from the fueling zone as indicated at block 232.

As will be appreciated by a person skilled in the art, the FIG. 7 example is one illustration of how a fuel dispensing system and method could be configured in accordance with the invention. As explained above, many other configurations are possible without departing from the invention. Depending upon its specific configuration, the system and method of the invention can achieve some or all of the following advantages:

(a) Refueling of the vehicle cannot commence until certain safety criteria are satisfied. For example, refueling cannot commence until the dispenser and the recipient are electrically bonded to minimize the risk of spark generation. Also the ordinarily mobile vehicle must be immobilized before refueling can commence.

(b) The ordinarily mobile vehicle cannot be inadvertently removed from the fueling zone during a fueling session.

(c) The fueling nozzle cannot be inadvertently decoupled from the fuel inlet during a fueling session.

(d) The fueling zone is monitored for fuel leaks during the fueling session. The fueling zone could also similarly be monitored for sparks or other fire hazards.

(e) The fueling session is automatically terminated in the case of any fuel leaks or system failures.

(f) After the fueling session is over, the ordinarily mobile vehicle will remain immobilized until all ground wires, communication lines or other tethers connecting the dispenser and recipient together have been disconnected and the fuel nozzle has been returned to its holster.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A system for regulating flow of fuel between a fuel dispenser having a fuel nozzle and a fuel recipient having a fuel receptacle during a fueling period, said system comprising:

(a) an electrical connector for electrically coupling said dispenser to said recipient;

(b) an interlock for lockably coupling said nozzle to a fuel inlet on said recipient in communication with said receptacle; and (c) an immobilization subsystem for preventing relative motion of said dispenser and said recipient during said fueling period, wherein at least one of said fuel recipient and said fuel dispenser comprises a mobile unit and wherein said immobilization subsystem disables power to said mobile unit during said fueling period, and wherein said mobile unit is a non-road electrical vehicle having a motor and wherein said immobilization subsystem disables power to said motor during said fueling period.

2. The system as defined in claim 1, further comprising a communication subsystem for transmitting control signals between said dispenser and said recipient.

3. The system as defined in claim 1, wherein said electrical connector is a ground cord connectable between said dispenser and said recipient.

4. The system as defined in claim 3, wherein said recipient is positionable within a fueling zone proximate said dispenser and wherein said ground cord is not extendable outside of said fueling zone.

5. The system as defined in claim 1, further comprising a fuel supply subsystem for preventing fuel flow from said dispenser to said recipient other than during said fueling period.

6. The system as defined in claim 5, wherein said fuel supply subsystem comprises a valve adjustable between an open position permitting flow of fuel through said nozzle into said inlet during said fueling period and a closed position preventing flow of fuel into said inlet.

7. The system as defined in claim 5, wherein said fuel supply subsystem comprises an adjustable fuel pump for pumping fuel through said nozzle into said inlet during said fueling period.

8. The system as defined in claim 1, wherein said interlock comprises a mechanical coupler for releasably coupling said nozzle to said inlet.

9. The system as defined in claim 1, wherein said electrical connector is wireless.

10. The system as defined in claim 2, further comprising a controller operatively coupled to said communication subsystem.

11. The system as defined in claim 5, further comprising a controller operatively coupled to said fuel supply subsystem.

12. The system as defined in claim 1, wherein said immobilization subsystem physically constrains said recipient within a fueling zone proximate to said dispenser during said fueling period.

13. The system as defined in claim 1, wherein said recipient is stationary and said dispenser is ordinarily mobile.

14. A system for regulating flow of fuel between a fuel dispenser having a fuel nozzle and a fuel recipient having a fuel receptacle during a fueling period, said system comprising:

(a) an electrical connector for electrically coupling said dispenser to said recipient;

(b) an interlock for lockably coupling said nozzle to a fuel inlet on said recipient in communication with said receptacle;

(c) an immobilization subsystem for preventing relative motion of said dispenser and said recipient during said fueling period; and (d) a fuel sensor for sensing the presence of fuel in the vicinity of said recipient external of said fuel receptacle during said fueling period.

15. The system as defined in claim 14, wherein said fuel sensor is a hydrogen sensor.

* * * * *